US007049995B2

(12) United States Patent
Nierzwick et al.

(10) Patent No.: US 7,049,995 B2
(45) Date of Patent: May 23, 2006

(54) METHOD AND APPARATUS FOR REMOTE CONTROL TRANSMISSION

(75) Inventors: Mark Alan Nierzwick, Brownsburg, IN (US); William John Testin, Indianapolis, IN (US); Joseph Wayne Forler, Zionsville, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 456 days.

(21) Appl. No.: 10/296,798

(22) PCT Filed: Jun. 1, 2001

(86) PCT No.: PCT/US01/17743

§ 371 (c)(1),
(2), (4) Date: Nov. 26, 2002

(87) PCT Pub. No.: WO01/95284

PCT Pub. Date: Dec. 13, 2001

(65) Prior Publication Data

US 2003/0227944 A1 Dec. 11, 2003

(51) Int. Cl.
*G08C 19/12* (2006.01)

(52) U.S. Cl. ..... 341/177; 370/505; 370/522; 375/238; 375/239; 375/259; 375/269; 398/106

(58) Field of Classification Search ..... 341/50, 341/53, 71, 177, 173; 375/259, 238, 369, 375/239, 269; 370/503, 522; 398/106
See application file for complete search history.

(56) References Cited

U.S. PATENT DOCUMENTS

| | | | | |
|---|---|---|---|---|
| 4,959,810 | A * | 9/1990 | Darbee et al. | 398/112 |
| 5,455,570 | A * | 10/1995 | Cook et al. | 340/825.22 |
| 5,602,873 | A * | 2/1997 | Balasubramanian et al. | 375/242 |
| 5,952,936 | A * | 9/1999 | Enomoto | 340/825.69 |
| 6,496,135 | B1 * | 12/2002 | Darbee | 341/173 |

FOREIGN PATENT DOCUMENTS

DE 3522832 1/1987

* cited by examiner

*Primary Examiner*—Timothy Edwards, Jr.
*Assistant Examiner*—Sisay Yacob
(74) *Attorney, Agent, or Firm*—Joseph J. Laks; Robert D. Shedd; Reitseng Lin

(57) ABSTRACT

A remote control is operative to transmit a remote control signal composed of a first portion and a second portion. The first and second portions are typically a pulse and a space. The pulse has a pulse width of a given duration within a pulse width range, while the space has a space width of a given duration within a space width range. An interrupt signal provided to indicate the end of transmission of the remote control signal is disabled when a space portion requires a space width greater than the space width range. The interrupt signal signaling the end of the remote control transmission is then disabled for a predetermined period of time essentially equivalent to a length of time that the additional space exceeds the space width. During the predetermined period of time, the remote control thus transmits a space. The interrupt signal is then re-enabled after expiration of the predetermined period of time in order to allow for another remote control transmission.

20 Claims, 8 Drawing Sheets

METHOD AND APPARATUS FOR REMOTE CONTROL TRANSMISSION

BACKGROUND OF THE INVENTION

1. Field of the Invention

The present invention relates to remote controls for electronic devices and, more particularly, to remote control transmissions.

2. Description of the Related Art

In modern consumer electronic devices such as television receivers, set-top boxes (e.g. cable boxes, satellite receivers, stereos, etc.) and the like (collectively, consumer electronic devices) many functions and/or features may be accessed and/or controlled via a remote control device. The remote control device may be user-actuated, as in the case of a hand-held remote control, or it may be device-actuated, in the case of a "relay" type remote control. In both cases, the remote control generates and transmits (wirelessly) a remote control signal that is received by the receiving electronic device. The control signal is encoded/coded in a manner appropriate for the receiving device. The receiving device receives the encoded/coded control signal and performs the requested command.

The remote control may use a variety of wireless transmission mediums in order to send or transmit the generated control signal from the remote control to the receiving electronic device. One type of remote control uses bursts of infrared (IR) light or radiation as the medium/vehicle for transmission of the encoded signals, which are received by a suitable receiving device associated with the consumer electronic device. The consumer electronic device may include a microprocessor for performing many receiver functions in addition to decoding received IR coded command signals and generating appropriate control signals in response thereto. An IR encoded command signal generally consists of a binary data stream of given word length in which the presence of a burst of infrared energy represents a binary 1 and the absence of infrared energy represents a binary 0.

IR transmissions from a remote control are typically made up of a series of pulses (high voltage/binary 1) and spaces (low voltage/binary 0) of varying lengths. Different combinations of the pulses and spaces are used to create unique IR codes. Each unique IR code represents a different key on the remote control. Consumer electronic devices may or may not use the same codes for the same or similar features. Thus, a remote control for one electronic device may not necessarily work with another electronic device.

A typical remote control includes transmitter circuitry that may be part of an integrated circuit (IC) and, more particularly, an application specific integrated circuit (ASIC). For typical transmissions utilizing the IR circuitry, the length of the pulse and the length of the space are individually specified in separate registers. The registers are loaded with a pulse/space combination when a key on the remote control is actuated. When an IR sequence is being transmitted, an interrupt is generated at the end of each pulse-space combination. At the time of the interrupt, the next pulse-space sequence or combination is loaded from user registers to transmission registers. At this time, it is safe for the remote to reload the user pulse and space registers so they are set up for the next pulse-space combination, which is the loaded at the next interrupt.

A problem with typical remote control circuitry that operates in the above manner, is that the IR transmitter only has a range of about ten microseconds (10 μsec) as a minimum to ten milliseconds (10 msec) as a maximum, in ten microsecond (10 μsec) increments, for each the pulse and space. However, some IR formats require space and pulse times greater than ten milliseconds. Since the minimum space or pulse time is only 10 microseconds instead of zero (0), the spaces or pulses cannot be concatenated to achieve spaces or pulses, respectively, greater than ten milliseconds.

It has been determine that a pulse greater than ten milliseconds may be provided by two pulses with a single ten microsecond space therebetween without creating a problem for the receiving device. Particularly, as an example, a ten microsecond drop in a ten millisecond pulse is less than one cycle (assuming a carrier of 56 KHz, the period is 17 μsec). However, it has determined that providing just a ten microsecond pulse between two spaces causes a discrimination problem for the remote control transmission receiver.

It is thus desirable to have a remote control that is operative to provide remote control transmissions of pulses and/or spaces that exceed the maximum pulse and/or space duration.

It is thus also desirable to have a method of transmitting a remote control signal when a pulse and/or space exceeds the maximum pulse and/or space duration.

SUMMARY OF THE INVENTION

The present invention is a remote control and associated method that provides a remote control transmission. In particular, the present invention is a remote control and associated method that provides an extended remote control transmission. More particularly, the present invention is a remote control and associated method that extends an operative range of pulse/space combination type remote control transmissions.

In one form, the present invention is a remote control that comprises a first circuit and timer circuitry. The first circuit is operative to generate a transmission comprising first and second portions. The first portion is of a duration within a first time range. The second portion is of a duration within a second time range. The first circuit is further operative to generate a signal indicative of an end of transmission of the first and second portions. The timer circuitry is in communication with the first circuit and is operative to render the first circuit signal inactive when a time length of a second portion exceeds the second time range. The timer circuitry is further operative to generate a replacement signal for the first circuit signal after expiration of the time length of the second portion.

In another form, the present invention is a method of generating a remote control transmission. The method includes the steps of: (a) generating a remote control transmission comprising first and second portions, the first portion of a duration that is within a first time range, and the second portion of a duration that is within a second time range; (b) generating a signal indicative of an end of transmission of the first and second portions; (c) inactivating the signal indicative of an end of transmission when a time length of a second portion exceeds the second time range; and (d) generating a replacement signal for the signal indicative of an end of transmission after expiration of the time length of the second portion.

In yet another form, the present invention is a method of extending a remote control transmission beyond a space width range of a remote control, the remote control having an integrated circuit operative to generate a remote control transmission comprising a pulse and space, the pulse having a pulse width within a pulse width range, and the space having a space width within a space width range, the integrated circuit further operative to generate a signal indicative of an end of transmission. The method includes the steps of: (a) providing an interrupt signal to the integrated circuit after transmitting the remote control transmission, the interrupt signal operative to temporarily disable generation of another remote control transmission; (b) providing a timing interval equal to an amount of time that said space is to exceed the space width range, the timing interval equivalent to a space; and (c) enabling generation of another remote control transmission after expiration of the timing interval.

BRIEF DESCRIPTION OF THE DRAWINGS

The above-mentioned and other features and advantages of this invention, and the manner of attaining them, will become more apparent and the invention will be better understood by reference to the following description of embodiment(s) of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
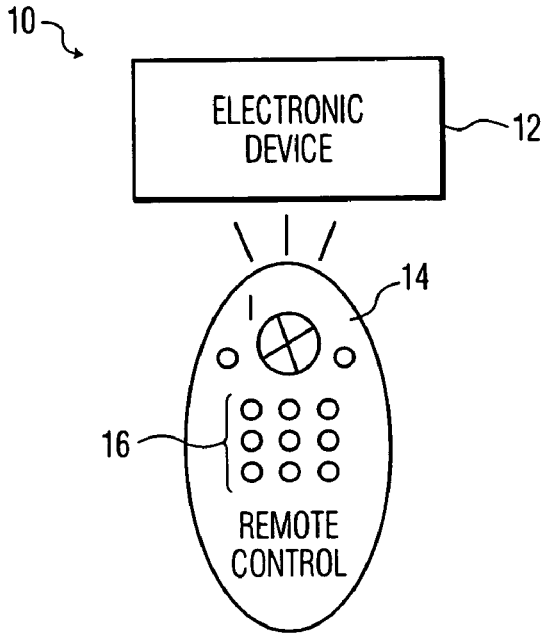
FIG. 1 is a representation of an exemplary system embodying the present invention.

Referring now to the drawings and, more particularly to FIG. 1, there is shown an exemplary electronic system, generally designated 10, in which the present invention may be embodied. The electronic system 10 includes an electronic device 12 and a remote control 14. The electronic device 12 is representative of any type of electronic device and, more particularly, any type of consumer electronic device. The consumer electronic device may be a television, television signal receiving device, VCR, DVD, or the like. The remote control 14 is representative of a typical, hand-held remote control that is operative to produce and send a transmission or control signal representing an action for the electronic device 12 to perform in response to actuation of a button or key 16 of the remote control 14.

The transmission of a remote control signal is preferably accomplished wirelessly and may take any form such as via radio frequency signals, infrared (IR) radiation or the like. The remote control signal may take any form, but is preferably a coded signal of a predefined or predetermined format. The electronic device 12 is operative to receive and decode the remote control signal. Once decoded, the electronic device 12 is operative to perform a particular command for the remote control signal.

The remote control 14 includes a plurality of buttons or keys 16 that allow a user to control at least some of the functions/features of the electronic device 12. Actuation or pressing of a button 16 causes the remote control 14 to produce and send a transmission corresponding to the button pressed. The button is associated with and initiates a function/feature of the electronic device 12. Each button is associated with a unique signal that is received and interpreted by the electronic device 12. When the electronic device 12 receives the unique signal, the unique signal is correlated to the appropriate feature/function and/or operation.

Figure 2:
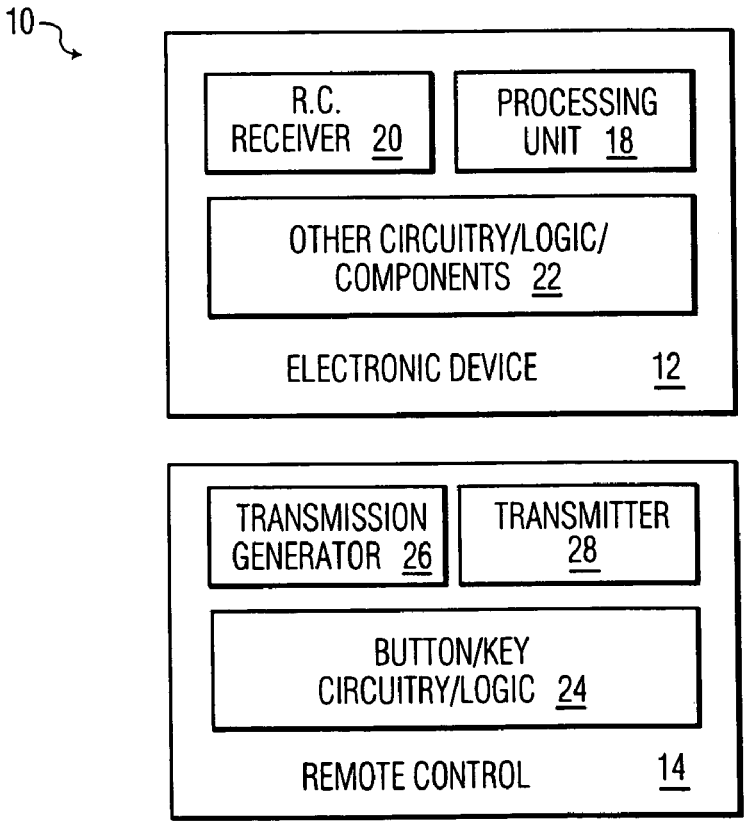
FIG. 2 is a simplified functional block diagram of the system of FIG. 1.

In FIG. 2, a simplified functional block diagram of the electronic system 10 is shown. The electronic device 12 includes a processing unit, circuitry and/or logic 18, a remote control signal receiver 20, and other various circuitry/logic/components 22. The processing unit 18 provides main processing for the electronic device 12. The receiver 20 provides reception of remote control signals from the remote control 14. Decoding of a remote control signal may be accomplished by the receiver 20 and/or by the processing unit 18. The other circuitry/logic/components 22 is representative of the various circuitry, logic and/or other components of the particular electronic device 12.

The remote control 14 includes button/key circuitry/logic 24 that is operative to receive a button/key signal from a button/key 16 of the remote control 14. The button/key circuitry/logic 24 interprets which button/key 16 of the remote control 14 was selected by the user. The remote control 14 further includes a transmission generator 26 that is operative to receive a button/key signal from the button/key circuitry/logic 24 and generate or produce an appropriate remote control signal (i.e. a remote control signal coded for the particular button/key selected). A transmitter 28 receives the coded remote control signal from the transmission generator 26 and transmits the coded remote control signal to the electronic device 12.

Figure 3:
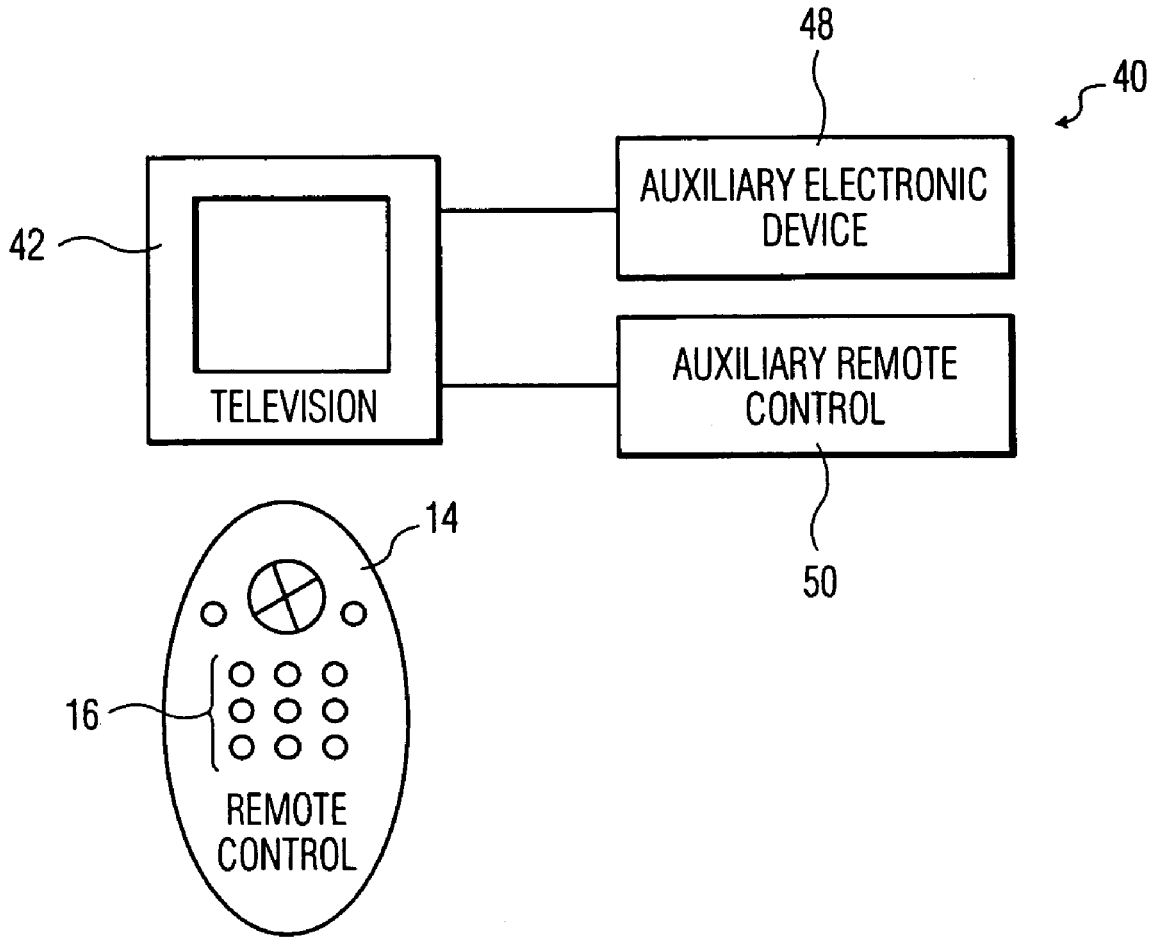
FIG. 3 is a representation of another exemplary system embodying the present invention.

Referring now to FIG. 3, there is depicted another exemplary system, generally designated 40, in which the present invention may be embodied. The electronic system 40 includes a television signal receiver 42 as an electronic device (typically and hereafter, television), a remote control 14 for the television 42, an auxiliary electronic device 17, and an auxiliary remote control 50. The auxiliary electronic device 48 may be a set-top box (i.e. cable box, satellite receiver, or the like), a DVD, a VCR, or any other electronic device that utilizes and/or processes television signals. Thus, the auxiliary electronic device 48 is in communication with the television 42. In addition, the electronic system 40 includes an auxiliary remote control 50 that is in communication with the television 42.

The remote control 14 includes a plurality of buttons/keys 16 and functions in like manner to the remote control 14 of the electronic system 10 of FIG. 1. The remote control 14 is operative to provide control signals to the television 42 in a predefined or predetermined format. The television 42 is operative to receive and interpret the remote control signals in order to perform the requested commands as provided by the remote control signals.

The auxiliary electronic device 48 is also operative to receive and interpret remote control signals. While not shown, the auxiliary electronic device 48 typically has an associated remote control device. The auxiliary electronic device 48, however, utilizes remote control signals of a predefined or predetermined format that is different than the predefined/predetermined format of the remote control 14. Rather than using two remote controls, the auxiliary remote control 50 is operative to convert and transmit any remote control signal from the remote control 14 for use by the auxiliary electronic device 48.

More particularly, the television 42 provides the remote control signal received from the remote control 14 to the auxiliary remote control 50 when it is necessary and/or appropriate for the auxiliary electronic device 48 to receive/utilize the particular remote control signal that was generated by the remote control 14. The auxiliary remote control 50 then provides an auxiliary remote control signal (preferably wirelessly) to the auxiliary electronic device 48. The auxiliary remote control 50 may need to convert or reformat the remote control signal received from the television 42 for the particular format scheme of the auxiliary electronic device.

Figure 4:
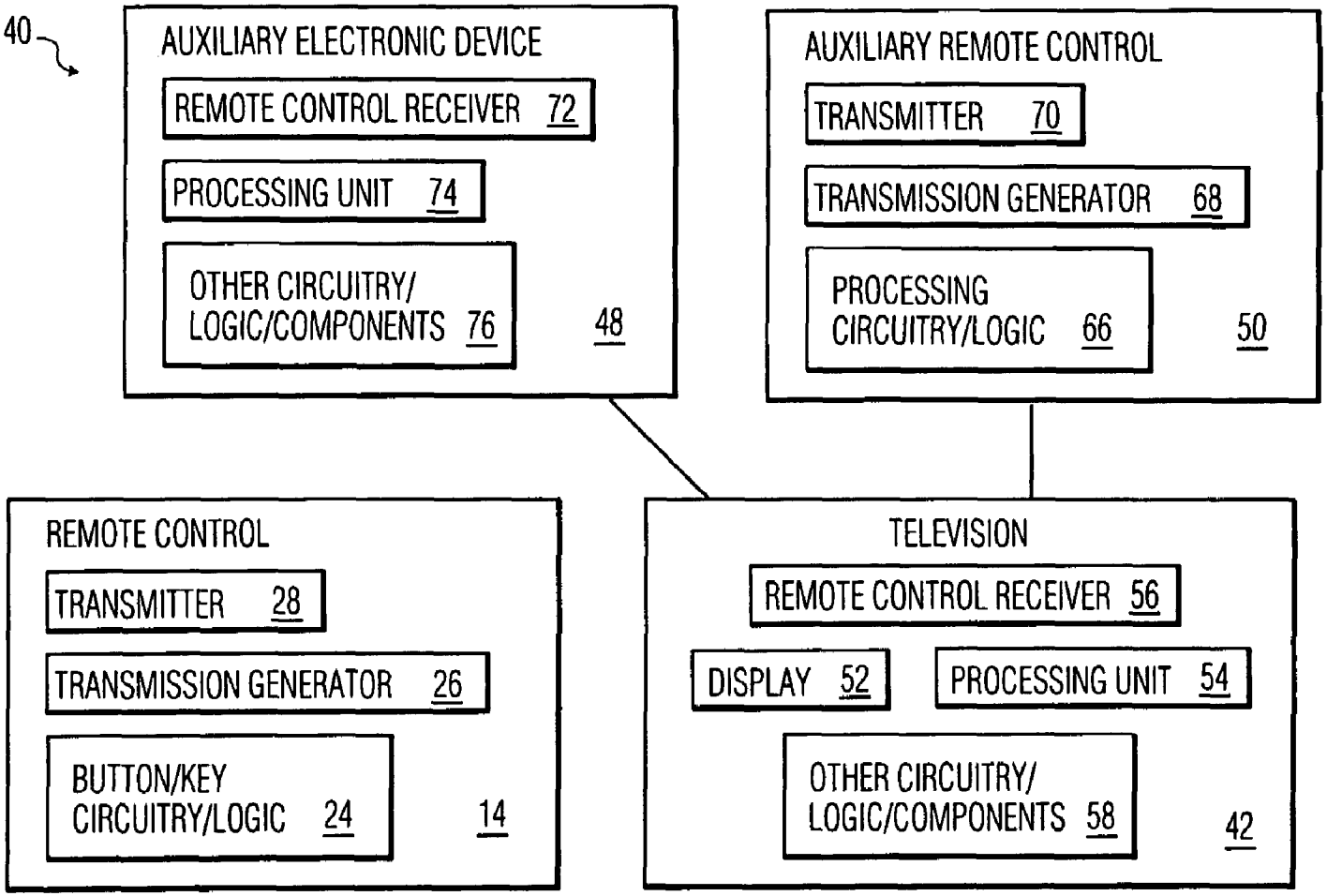
FIG. 4 is a simplified functional block diagram of the system of FIG. 3.

In FIG. 4, a simplified functional block diagram of the electronic system 40 is shown. The remote control 14 includes button/key circuitry/logic 24, a transmission generator 26 and a transmitter 28. The button/key circuitry/logic 24 is operative to receive a button/key signal from a selected/pressed button/key 16. The transmission generator 26 is operative to generate/produce a coded remote control signal for the particular button/key selected. The transmitter 28 is operative to transmit (preferably wirelessly, such as via IR) the coded remote control signal. The television 42 includes a display 52, a processing unit 54, a remote control signal receiver 56, and other circuitry/logic/components 58. The remote control receiver 56 is operative to receive a remote control signal from the remote control 14. The processing unit 54, along with the other circuitry/logic/components, processes the remote control signal appropriately.

The auxiliary remote control 50 includes processing circuitry/logic 66, a transmission generator 68, and a transmitter 70. The processing circuitry/logic 66 is operative to receive the remote control signal from the television 42 which received the remote control signal from the remote control 14. The transmission generator 68 is operative to provide an auxiliary remote control signal that is coded for the format of the auxiliary electronic device 48. The transmitter 70 is operative to transmit the auxiliary remote control signal to the auxiliary electronic device 48.

The auxiliary electronic device 48 includes a processing unit 74, a remote control receiver 72, and other circuitry/logic/components 76. The remote control receiver 72 is operative to receive an auxiliary remote control signal from the auxiliary remote control that is formatted for the auxiliary electronic device 48.

Figure 5:
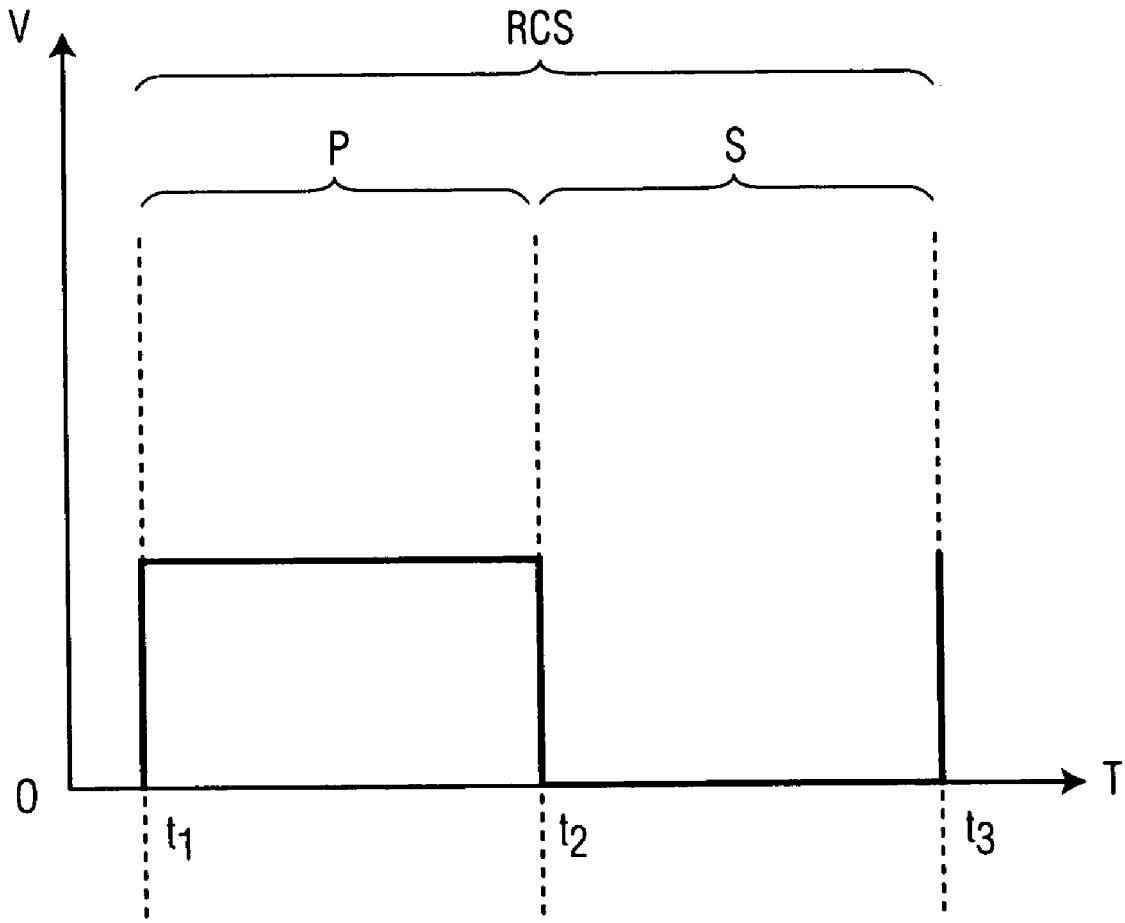
FIG. 5 is a graph of an exemplary remote control signal format.

Referring to FIG. 5, there is shown a graphical representation of an exemplary remote control signal, generally designated ROS (Remote Control Signal), produced and/or generated by any one of the remote control devices 14, and/or 50. The RCS consists of a first portion P, and a second portion S. The first portion P is a pulse portion of the remote control signal, while the second portion S is a space portion of the remote control signal. The first portion P is constrained to be within a first or pulse time range, duration, or pulse width designated as between $t_1$ and $t_2$, while the second portion S is constrained to be within a second or space time range, duration, or space width designated as between $t_2$ and $t_3$. Each time range has a non-zero duration or minimum duration and a maximum duration. Typically, the pulse time range is between about ten microseconds (10 μsec) to ten milliseconds (10 msec), while the space time range is between about ten microseconds (10 μsec) and ten milliseconds (10 msec). Each button/key of the remote control thus has a unique pulse-space combination (a pulse of a predetermined time range plus a space of a predetermined time range) that is generated and transmitted.

Figure 8:
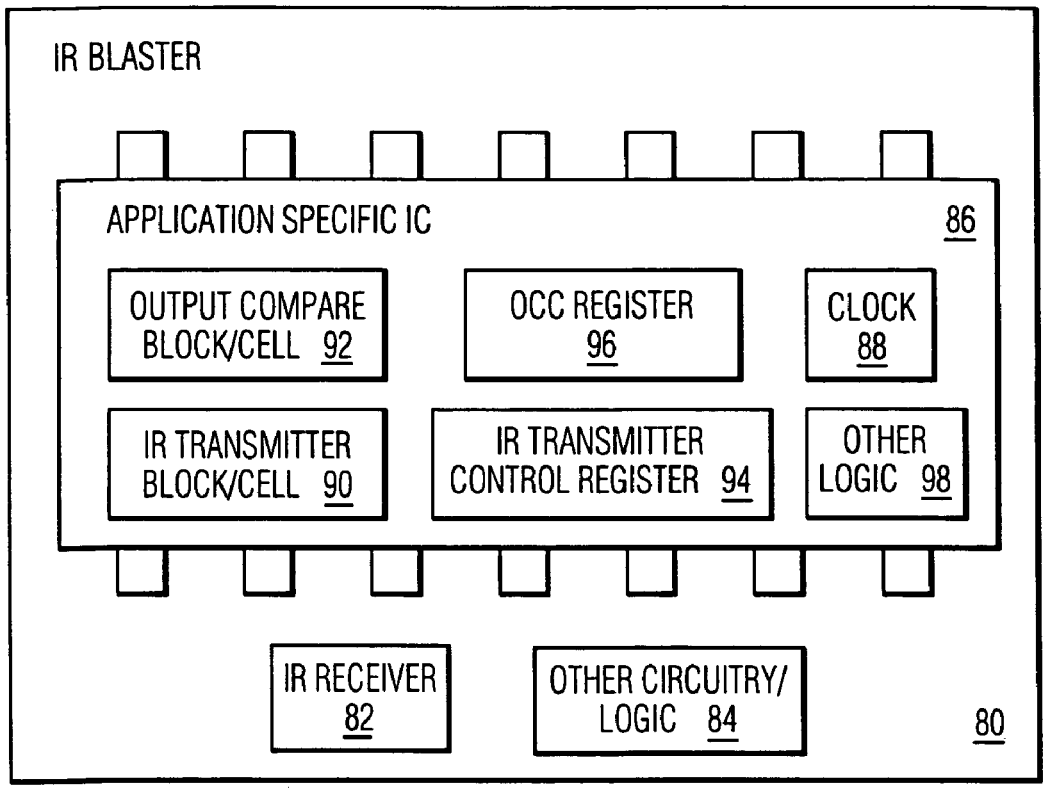
FIG. 8 is a block diagram of a particular embodiment of the present invention.

Referring to FIG. 8, there is depicted a simplified block diagram of an auxiliary remote control, generally designated 80, and known as an IR Blaster. The IR Blaster is manufactured by Thomson Consumer Electronics of Indianapolis, Ind. The IR Blaster 80 is typical of "IR blaster" devices in which an incoming signal (here a remote control signal) is amplified and/or retransmitted in an IR format to control another electronic device (see FIGS. 3 and 4). In this embodiment, the IR Blaster 80 is utilized to receive, amplify, and retransmit incoming IR remote control signals. The retransmitted IR remote control signals are in an IR/remote control format that is compatible with an auxiliary electronic device. The IR Blaster 80 has IR receiver circuitry/logic 82, an application specific integrated circuit (ASIC) 86, and other circuitry/logic 84. The ASIC 86 is operative to generate/produce and output/transmit IR remote control signals.

Figure 6A:
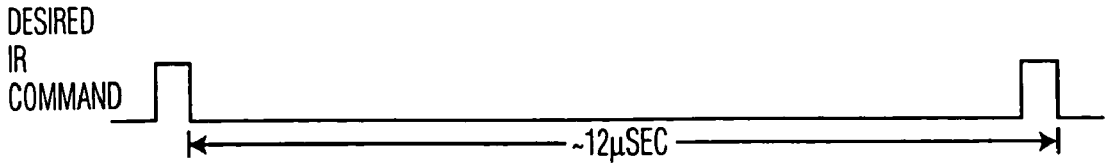
FIGS. 6A–E are timing diagrams for various remote control signals in accordance with an aspect of the present invention.
Figure 6B:
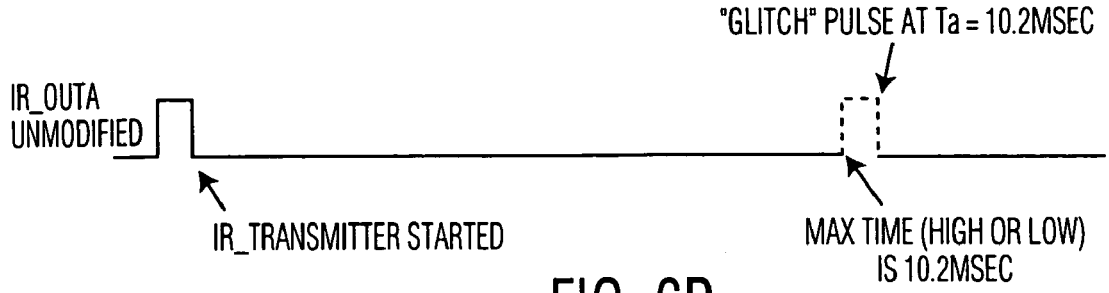

The ASIC 86 includes, among other circuitry/logic 98, a clock cell 88, an IR transmitter block/cell 90, an output compare block/cell 92, an IR transmitter control register 94, and an output compare control register 96. For IR transmissions that do not need modifying, the ASIC provides a pulse and space combination to the IR transmitter control register 94 before the IR remote control signal (the pulse and space combination signal) is transmitted by the IR transmitter cell 90 (i.e. a "normal" is IR transmission). Because of various design considerations, the ASIC 86 is normally constrained to provide a pulse and space combination within pulse and space durations such as described above. When a pulse is to exceed the maximum pulse width, the ASIC provides a space of minimum space width after the pulse of maximum pulse width before another pulse of the remaining pulse time width. The receiving electronic device is typically not affected by the minimum width space within the extended pulse. However, when a space is to exceed the maximum space width, such as that shown in FIG. 6A, the addition of a pulse of minimum pulse width will not generally be accepted by the receiving electronic device. As shown in FIG. 6B, the normal IR output (IR_OUTA UNMODIFIED) from the ASIC produces an unwanted "glitch" pulse at the end of the maximum space width.

In accordance with an aspect of the present invention, when it is necessary for the ASIC to produce and transmit an IR remote control signal that has a space that is greater than the maximum space width, the ASIC is disabled in order to generate an extended space. In particular, the ASIC IR transmitter cell 90 is disabled while an extended space is generated/produced. The generation/production of the extended space remote control IR signal is provided via a "hardware" embodiment/implementation and/or a "software" embodiment/implementation.

Figure 6C:
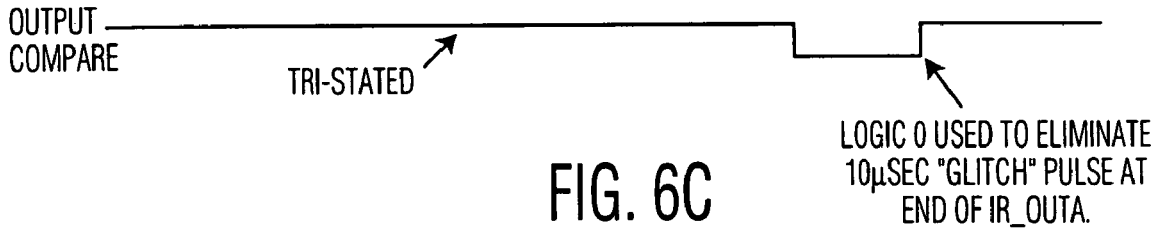
Figure 6D:
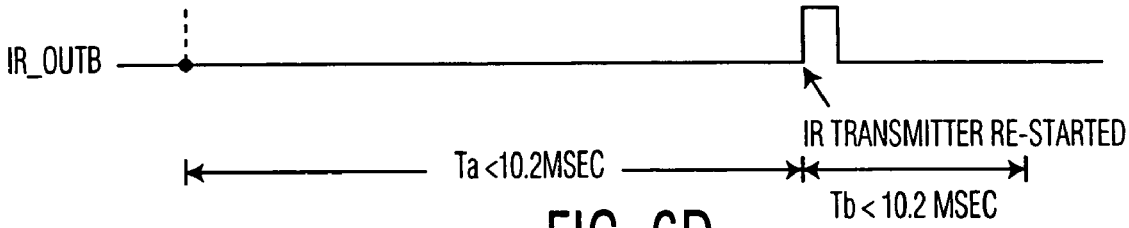
Figure 6E:
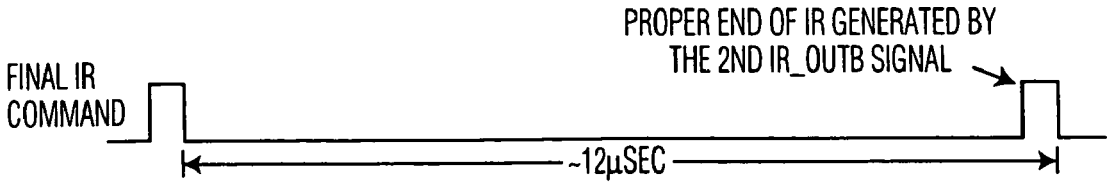

According to the software embodiment of the present invention, when the ASIC 86 is to produce a space of greater duration than the minimum space width, the output compare timer cell 92 is utilized as an internal software timer while the associated output pin of the ASIC is not used. The IR transmitter cell 90 is utilized to generate the pulse, while the output compare timer cell 92 generates/provides the space. More particularly, when a current pulse-space sequence expires, the IR transmitter cell 90 is rendered inactive by not reloading the pulse and space register 94 for a next sequence. While the IR transmitter cell 90 is inactive, a (logic) low (0 volts) is output on the associated IR_OUT pin of the ASIC 86. The output compare cell 92 is then set up to expire (i.e. generate an interrupt) at the end of the desired space extension duration (see FIG. 6E). Once the desired extended space duration expires, an output compare timer interrupt is generated. The output compare timer interrupt activates the IR transmitter cell 90 wherein a pulse and space sequence is then loaded into the IR transmitter control register 94 for transmission of the next pulse-space combination.

Figure 7:
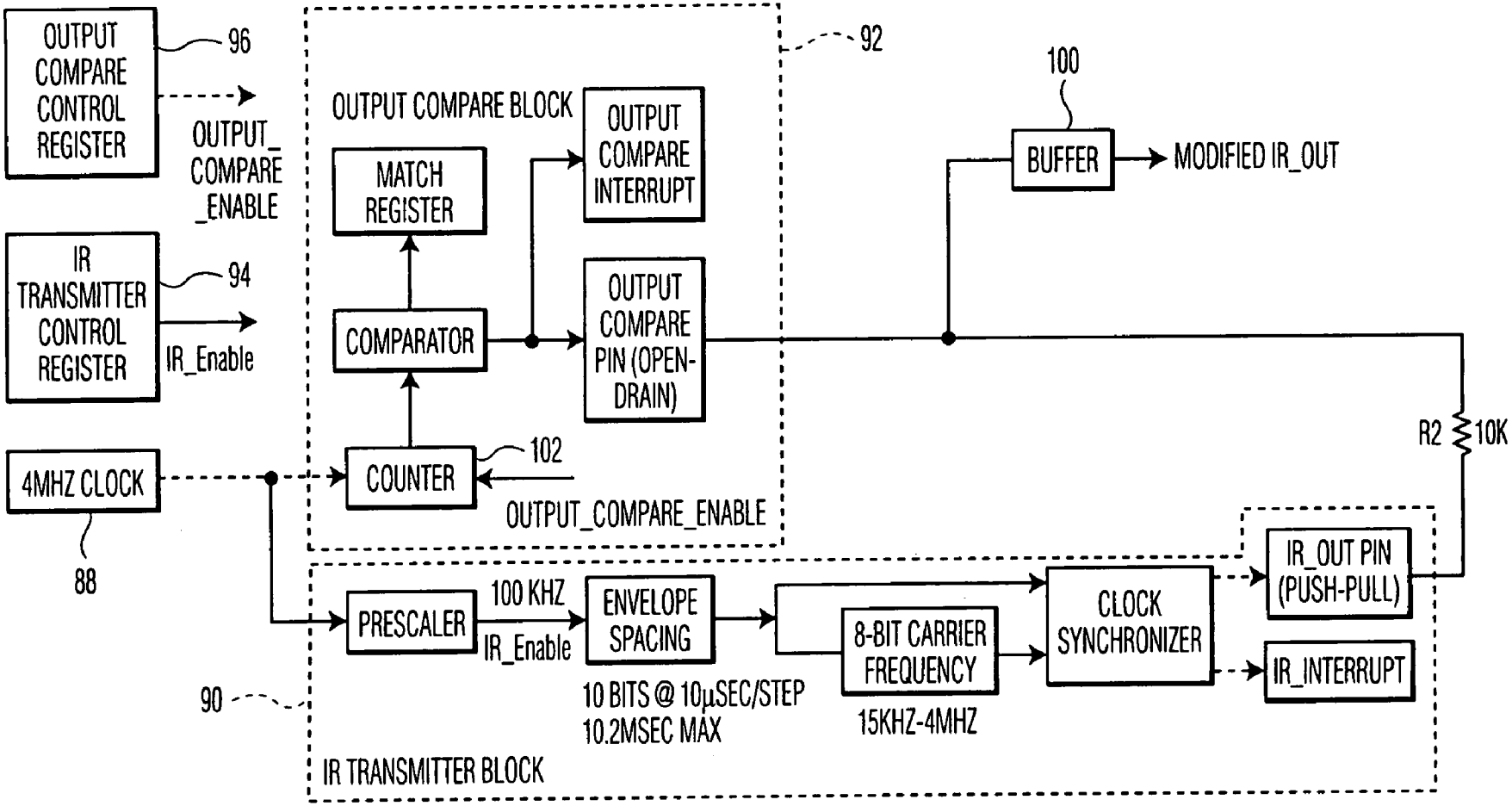
FIG. 7 is a block diagram of an embodiment of the present invention.

According to a hardware embodiment/implementation of the present invention and referring additionally to FIG. 7, when the ASIC 86 is to produce a space of greater duration than the minimum space width, the IR transmitter cell 90 is rendered inactive in preferably the same manner as the "software" implementation. However, an output/output pin of the out compare timer is set up to drive the desired space (or unmodulated pulse) on the associated output pin. When driven, the output of the output compare timer cell 92, via the output compare control register 96, will override the IR transmitter output based on the resistance value selected for associated signals as described below. The output compare is thus set up as an "open drain" which would not have any effect in the (logic) high state, but would ground the IR-OUT signal in a (logic) low condition. The output compare timer 92 can be triggered or started on either the rising or falling edge of the IR pulse. In the case that the falling edge is used, the output compare timer cell 92 is used to hold the IR_OUT low until a timeout is reached, at which point an interrupt is generated. The interrupt then disables the output compare timer 92 and enables the IR_OUT for the next pulse. This is graphically illustrated by the timing diagrams of FIGS. 6C, 6D, and 6E.

FIG. 7 illustrates in block diagram form, the use of the output compare block/cell 92 to provide a space to the buffer 100 to provide a modified IR_OUT signal. The output compare register 96 provides an output compare enable signal to the output compare block 92 in order to have the output compare block 92 provide the extended space width. The various blocks of the output compare cell 92 provide timing and output of the extended space width to the buffer 100. The signal from the output compare cell 92 overrides any output from the IR transmitter block 90 by the resistor R2. The value of the resister R2 is chosen to be in the ratio of 10:1 to ensure that the IR-OUT signal can be overdriven by the output compare.

Figure 9:
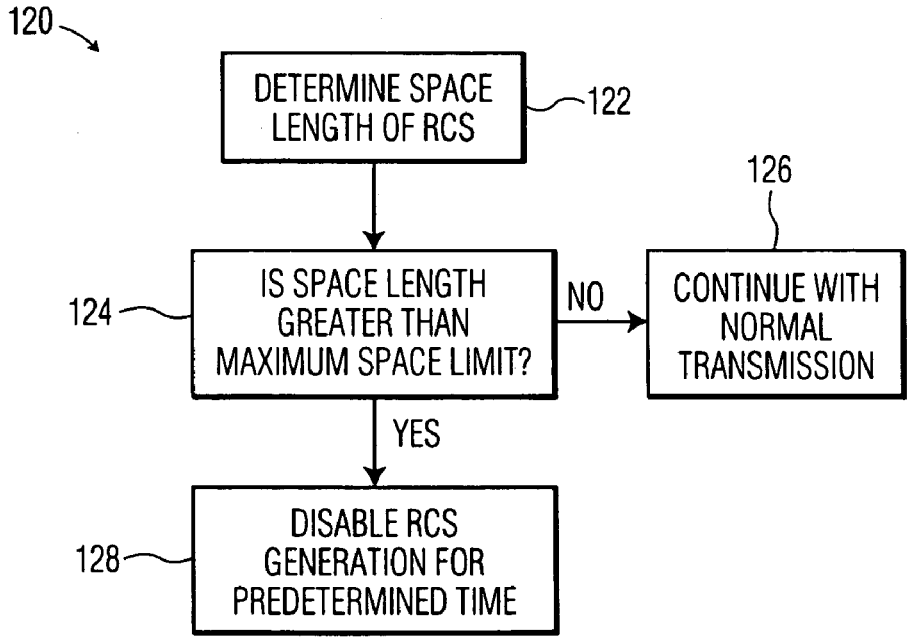
FIG. 9 is a flow diagram depicting a simplified overview of a manner of operation of the present invention.

Referring to FIG. 9, there is shown a flowchart, generally designated 120, of an exemplary general manner of operation of the present invention. Initially, in step 122, the remote control determines the space length of the remote control signal (RCS) to be sent. Once the space length of the RCS is determined, it is determined whether the space length exceeds the maximum space width, step 124. If the RCS does not exceed the maximum space width, then the remote control continues with normal transmission of the RCS by the IR transmitter, step 126. However, if it is determined that the RCS needs to exceed the maximum space width, RCS generation by the IR transmitter is disabled for a predetermined time corresponding substantially to the length of time of the extended portion of the space, step 128. This process occurs whether the present invention is implemented in hardware or software.

Figure 10:
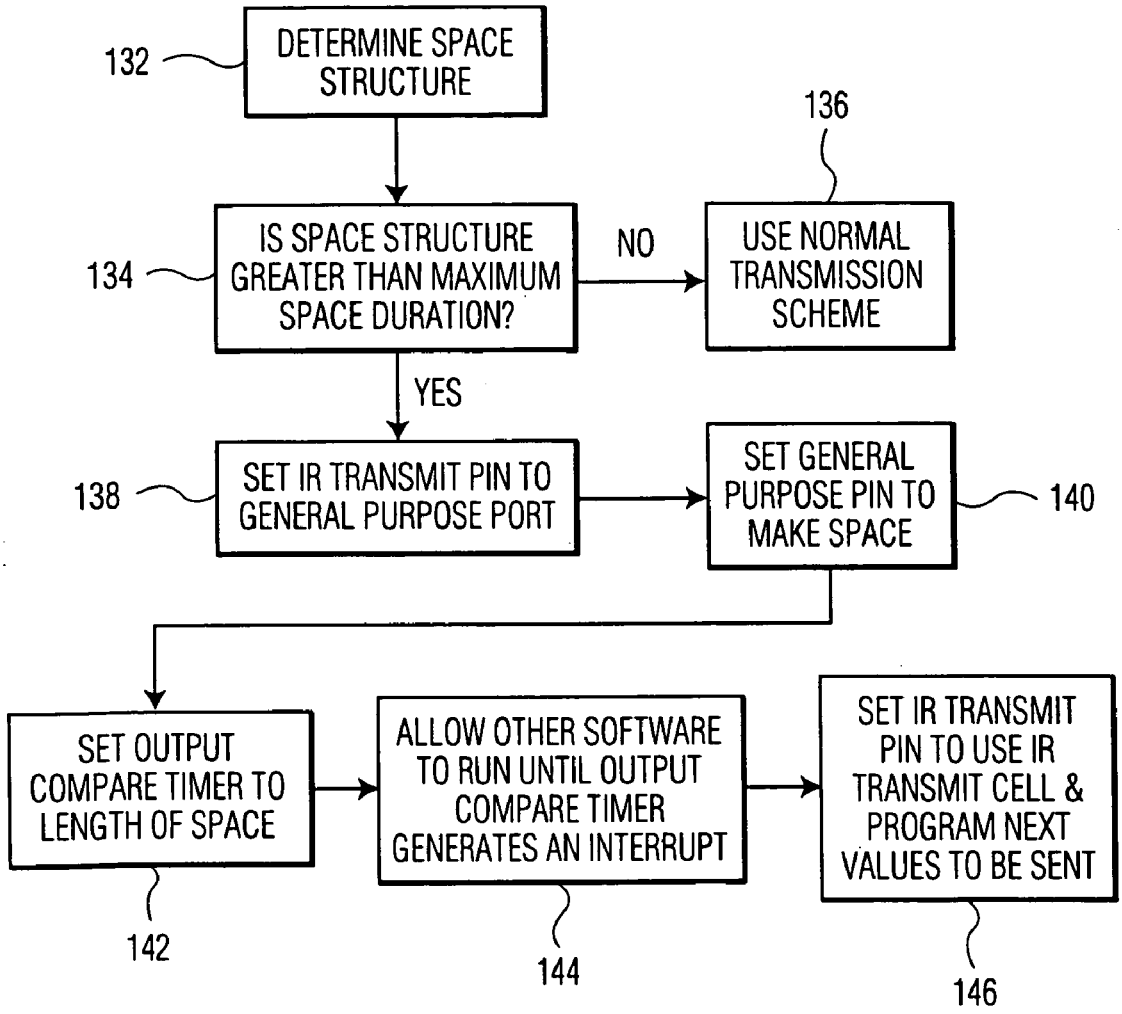
FIG. 10 is a flow diagram depicting a more particular exemplary manner of operation of an embodiment of the present invention.

Referring to FIG. 10, there is shown a flowchart, generally designated 130, illustrating an exemplary manner of operation of the present invention with respect to the hardware implemented embodiment of the present invention. In step 132, the space structure (i.e. the length of the space) is determined. If the space structure is not greater than the maximum space width, step 134, then the normal transmission scheme is used by the IR transmitter, step 136. Else, if in step 134 it is determined that the space structure is greater than the maximum space width, the IR transmit pin of the ASIC is set to a general purpose port, step 138. In step 140, the general purpose pin is set to make a space. The output compare timer of the output compare cell is set to time the length of the desired extended space, step 142. Any other software is allowed to be executed until the output compare timer generates an interrupt, step 144. Thereafter, the IR transmit pin is set to use the IR transmit cell, step 146. As well, the IR transmitter is set to set up the next pulse-space sequence.

While this invention has been described as having a preferred design, the present invention can be further modified within the spirit and scope of this disclosure. This application is therefore intended to cover any variations, uses, of adaptations of the invention using its general principles. Further, this application is intended to cover such departures from the present disclosure as come within known or customary practice in the art to which this invention pertains and which fall within the limits of the appended claims.

The invention claimed is:

1. A remote control for generating a first transmission comprising first and second portions having respective first and second durations, the remote control comprising:

a first circuit operative to generate the first transmission if said first and second durations are not respectively greater than first and second time ranges, and generate a second transmissions having the first portion having the first duration and the second portion having a duration of the second time range if the second duration is greater than the second time range, wherein the first circuit generates a signal indicative of an end of transmission of either of said first and second transmissions; and timer circuitry in communication with said first circuit and operative to render said end of transmission indicative signal inactive when the first circuit has generated the second transmission, and to generate a replacement signal for said end of transmission indicative signal.

2. The remote control of claim 1, wherein said first portion comprises a pulse and said second portion comprises a space.

3. The remote control of claim 1, wherein said first circuit and said timer circuitry are incorporated into an integrated circuit.

4. The remote control of claim 3, wherein said integrated circuit is an application specific integrated circuit.

5. The remote control of claim 1, wherein said first circuit is operative to generate a transmission utilizing infrared radiation.

6. The remote control of claim 1, wherein said first time range is ten microseconds to ten milliseconds and said second time range is ten microseconds to ten milliseconds.

7. The remote control of claim 1, wherein said end of transmission indicative signal comprises an interrupt.

8. The remote control of claim 1, wherein said first circuit comprises a transmitter cell and said timer circuitry comprises an output compare timer cell.

9. A method of generating a first remote control transmission comprising first and second portions having respective first and second durations wherein the first duration is no greater than a first time range but the second duration is greater than a second time range, the method comprising the steps of:

generating a second remote control transmission comprising the first portion having the first duration and the second portion having a duration of the second time range;

generating a signal indicative of an end of transmission of the second transmission;

inactivating the end of transmission indicative signal when the second transmission has been generated; and generating a replacement signal for the end of transmission indicative signal.

10. The method of claim 9, wherein the first portion comprises a pulse and the second portion comprises a space.

11. The method of claim 9, wherein the step of inactivating the end of transmission indicative signal includes:

inactivating the of end of transmission indicative signal via software.

12. The method of claim 9, wherein the step of inactivating the end of transmission indicative signal includes:

inactivating the end of transmission indicative signal via hardware.

13. The method of claim 9, wherein said first time range is ten microseconds to ten milliseconds and said second time range is ten microseconds to ten milliseconds.

14. The method of claim 9, wherein the step of generating the second remote control transmission includes generating a remote control transmission of infrared radiation.

15. The method of claim 9, wherein the steps of generating the second remote control transmission and generating the end of the transmission indicative signal are performed by a transmitter cell, and the steps of inactivating the end of the transmission indicative signal and generating a replacement signal are performed by an output compare timer cell.

16. In a remote control having an integrated circuit operative to generate a first remote control transmission comprising a first pulse and a first space, the first pulse having a pulse width no greater than a pulse width range, and the first space having a space width no greater than a space width range, the integrated circuit further operative to generate a signal indicative of an end of transmission, a method of generating a second remote control transmission comprising second pulse and space having respective second pulse and space widths wherein the second space width is greater than the space width range, the method comprising the steps of:

providing a signal to the integrated circuit when the integrated circuit has generated a third remote control transmission having the second pulse having the second pulse width and a third space having a space width equal to the space width range, the signal operative to temporarily disable generation of another remote control transmission;

providing a timing interval equal to an amount of time equivalent to a difference between the second space width and the third space width, a signal present at an output of the integrated circuit during the timing interval equivalent to a space; and enabling generation of another remote control transmission after expiration of the timing interval.

17. The method of claim 16, wherein the enabling step further comprising the step of generating an interrupt signal via software.

18. The method of claim 17, wherein the interrupt signal via hardware.

19. The method of claim 16, wherein the step of providing a timing interval comprises providing a timing interval via an output compare timer cell.

20. The remote control of claim 1, wherein the replacement signal lasts for an interval equal to a difference between the second duration and the second time range.

* * * * *